United States Patent [19]

Kueenzle et al.

[11] Patent Number: 4,460,813

[45] Date of Patent: Jul. 17, 1984

[54] LOAD BREAK SWITCH DRIVE MECHANISM

[75] Inventors: Paul Kueenzle; Karl-Heinz Voss, both of Berlin, Fed. Rep. of Germany

[73] Assignee: Siemens Aktiengesellschaft, Berlin and Munich, Fed. Rep. of Germany

[21] Appl. No.: 358,276

[22] Filed: Mar. 15, 1982

[30] Foreign Application Priority Data

Mar. 20, 1981 [DE] Fed. Rep. of Germany ..... 3111792

[51] Int. Cl.[3] ..... H01H 33/12

[52] U.S. Cl. ..... 200/146 R; 200/148 F

[58] Field of Search ..... 200/146

[56] References Cited

FOREIGN PATENT DOCUMENTS

| | | |
|---|---|---|
| 672244 | 2/1939 | Fed. Rep. of Germany . |
| 946638 | 8/1956 | Fed. Rep. of Germany . |
| 967500 | 12/1957 | Fed. Rep. of Germany . |
| 1590872 | 5/1970 | Fed. Rep. of Germany . |
| 2711342 | 9/1978 | Fed. Rep. of Germany . |
| 2742772 | 3/1979 | Fed. Rep. of Germany . |
| 2907574 | 8/1980 | Fed. Rep. of Germany . |
| 808888 | 11/1936 | France . |
| 813635 | 3/1937 | France . |
| 814302 | 3/1937 | France . |
| 2175619 | 9/1977 | France . |
| 794191 | 4/1958 | United Kingdom . |

OTHER PUBLICATIONS

Siemens Zeitschrift, vol. 41, No. 4 (1967), pp. 321-322.

*Primary Examiner*—Robert S. Macon

*Attorney, Agent, or Firm*—Karl F. Milde, Jr.; Andrew G. Rodau

[57] ABSTRACT

An improved drive mechanism for a "swivel type" load break switch has actuating means arranged generally within the plane of switch support frame in a space between the actuating shaft and an insulating post supporting cross member. The actuating shaft extends between side members of the support frame and projects beyond the side members at each side to permit attachment of a tool to open or close the switch. An advantageous arrangement of pawls, levers and springs connects the actuating shaft to the shaft that carries the pivoting switch contact post. The invention enables the construction of a relatively small, compact and simple load break switch.

7 Claims, 6 Drawing Figures

LOAD BREAK SWITCH DRIVE MECHANISM

BACKGROUND OF THE INVENTION

1. Field of the Invention

This invention relates to medium range voltage load break switches and in particular to an improved drive mechanism therefor.

2. Description of the Prior Art

Examples of prior art load break switches are described in German Auslegeschrift DE-AS No. 2,711,342 and in Siemens Zeitschrift, Vol. 41, No. 4 (1967), at pages 321-322.

Typical load break switches may take the form of "swivel post" type switches which have first and second current lead terminals mounted atop separate fixed, generally vertical insulator posts. A contact connected by means of a flexible conductor to one of the current lead terminals is mounted atop a third insulator post positioned between the insulator posts which carry the first and second current lead terminals. The third insulator post is pivotable about its lower end between a position wherein the carried contact establishes connection between the current lead terminals and a position wherein the contact does not establish contact between the current lead terminals.

A "swivel post" load break switch is usable in a wide range of medium voltage load switching applications. The switch may be designed to make or break contact at the option of the user. Alternatively, it may be connected to respond automatically, as for example, to fault protection equipment in the control of power distribution networks. The pivoting of the "swivel post" contact is under the control of the contact breaker drive mechanism.

SUMMARY OF THE INVENTION

It is an object of the present invention to provide an improved drive mechanism for a load break switch which expands the actuation possibilities of the switch.

It is a further object of the invention to provide an improved drive mechanism for a load break switch which enables the construction of a relatively small, compact and simple switch.

In accordance with one aspect of the invention, a load break switch, such as a load break switch of the "swivel post" type has a generally planar support frame with two cross members connected between two side members. The cross members serve as supports for fixed assemblies of adjacent current paths. A drive mechanism provided within the structure of the support frame has an actuating shaft mounted on the side members, a switch shaft and actuating components including springs coupling the actuating shaft and the switch shaft for opening and closing the switch. The actuating shaft is constructed to project beyond the side members at each side of the support frame. This makes it possible, unhindered by external drive parts, to attach a hand lever or similar tool to the actuating shaft extensions on either side of the support frame for the purpose of closing or opening the switch.

In another aspect of the invention an improved drive mechanism is provided by an advantageous arrangement of springs connecting the actuator shaft and the switch shaft. In a preferred embodiment of the invention, described in greater detail below, the springs are arranged generally within the plane of the frame and together with the associated other actuation components are positioned in the space between the actuating shaft and one of the two fixed insulator post supporting cross members. This arrangement provides for a compact break switch, whose frame dimensions do not exceed the minimum dimensions required for mechanical stability.

In the preferred configuration, described in greater detail below, the actuating shaft can be so configured that, when the switch is in its open state, an insulating plate can be inserted between the elements of the drive mechanism and the current lead elements not connected by the flexible lead to the contact carried by the "swivel post". The insulating plate thus can shield the drive parts during maintenance work to increase workers' safety.

The arrangement of the springs in the illustrative embodiment described below is advantageous in that the closing springs as well as the opening springs are connected by their one ends with a guide rod which is moveably mounted within one of the cross members and are positioned so that their other ends interact with a lever mounted on the actuating shaft. The lever may be short, since with appropriate selection of springs a sufficient tensioning moment can be obtained even with a short lever arm. The advantage of this arrangement is its compactness which is achieved by the elimination of link levers or similar parts.

The described drive mechanism is made to operate as a snap drive in a simple manner by providing pawl arms, one for closing and one for opening, which are mounted on one side of one of the cross members. The pawl arms engage each other in plier fashion around a ratchet disc mounted on the switch shaft. The arms can be lifted out of the steps in the ratchet disc by means of a release pin on the actuating shaft. During closing, both the closing and opening springs are stressed by rotation of the actuating shaft. The switch shaft is, however, prevented by the closing pawl arm from rotating until at sufficient tension of the closing spring the release pin on the actuating shaft lifts the closing pawl arm out of the step on the disc and releases the switch shaft. In the closing position, the switch shaft is retained by the opening pawl against the action of the tensioned opening spring. By rotating the actuating shaft in the direction of opening, the release pin lifts the opening pawl out and thereby releases the switch shaft in the direction of opening. Thus, the drive mechanism acts as a snap drive during closing of the break switch, while in opening the switch it acts as a stored-energy drive. Both switching operations are effected by appropriate rotational movements of the actuating shaft.

An advantage of the improved drive mechanism of the invention is that a break switch constructed in accordance with the principles of the invention can be made automatically releasable. A modified embodiment of the invention, described in greater detail below, utilizes a pawl arm which is pivotable about a fixed bearing and engages in sliding block fashion on the guide rod of the opening spring. In this manner the opening spring itself is retained. By installing the lock mechanism of the guide rod of the opening spring, an active locking direction is obtained so that switch closing can be established in a simple manner, as for example through the action of the release pin of an HH fuse or other suitable tripping device.

There have thus been outlined rather broadly certain objects, features and advantages of the invention in order that the detailed description that follows may be better understood, and in order that the present contribution to the art may be better appreciated. There are, of course, additional features of the invention that will be described more fully hereinafter. Those skilled in the art will appreciate that the conception on which this disclosure is based may readily be utilized as the basis for the designing of other arrangements for carrying out the purposes of this invention. It is important, therefore, that this disclosure be regarded as including all such equivalent arrangements that encompass the spirit and scope of the invention.

BRIEF DESCRIPTION OF THE DRAWINGS

Embodiments of the invention have been chosen for purposes of illustration and description, and are shown in the accompanying drawings forming a part of the specification, wherein.

Throughout the drawings like elements are referred to by like numerals.

DESCRIPTION OF THE PREFERRED EMBODIMENTS

Figure 1:
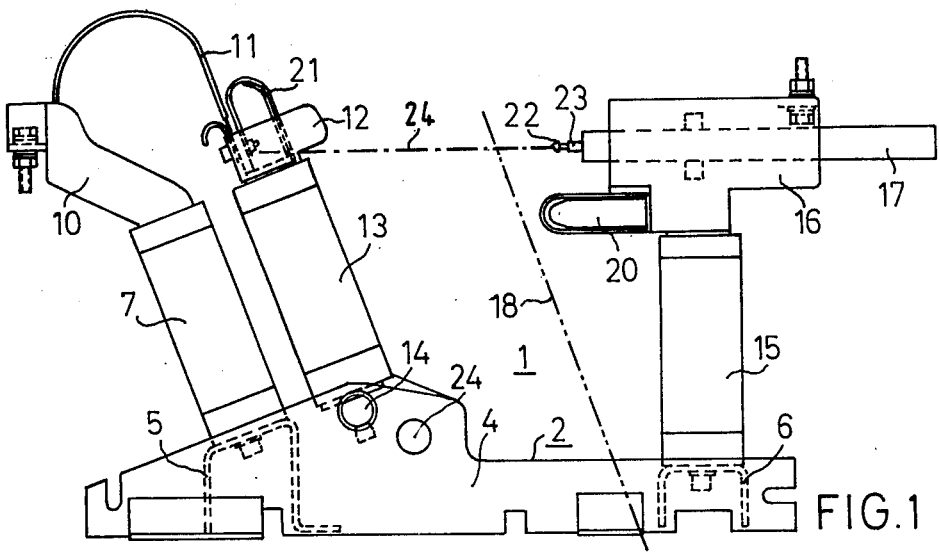
FIG. 1 is a side elevation view of an embodiment of a break switch in accordance with the invention.
Figure 2:
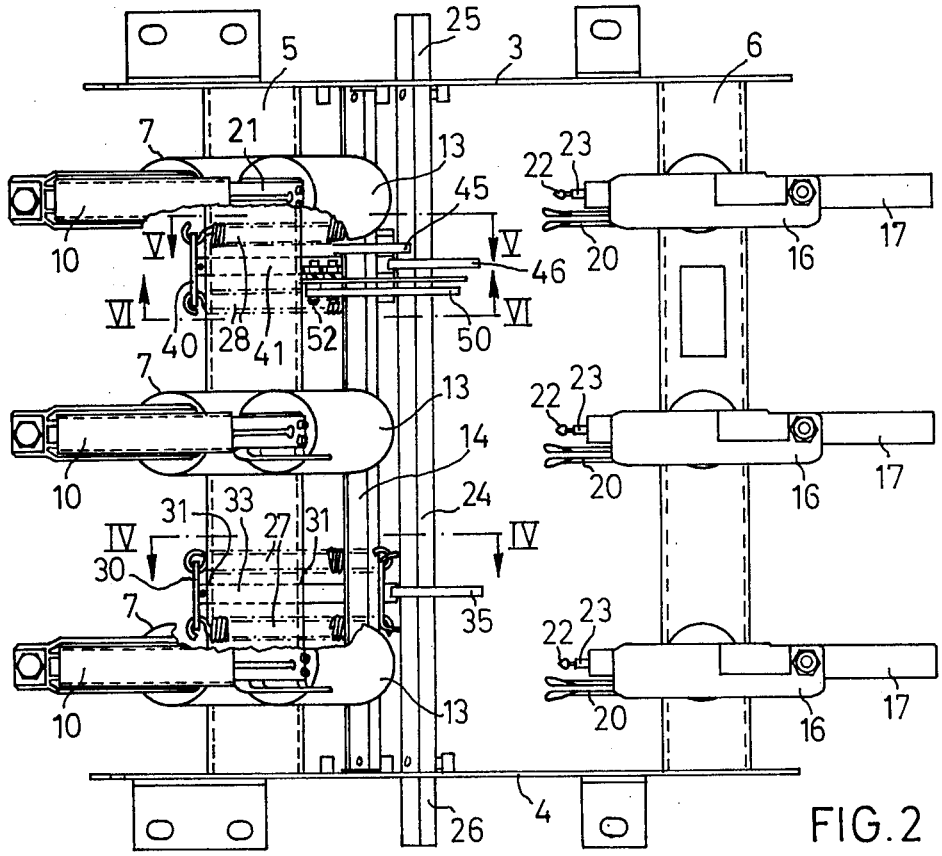
FIG. 2 is a top plan view, with portions cut away, of the break switch of FIG. 1.

FIGS. 1 and 2 show an illustrative embodiment of a medium voltage range break switch of the "swivel post" type. The basic design principles relating to "swivel post" break switches are disclosed, for example, in French Patent No. 813,635.

The break switch 1 has a support frame 2 which consists of two side members 3 and 4 which are connected by means of two cross members 5 and 6. The cross members 5 and 6 serve as supports for the fixed parts of three parallel current paths of the break switch which are arranged in spaced relationship. Three insulator posts 7, each of which carries a current lead terminal 10, are supported on the cross member 5. The current lead terminals 10 have a pocket form designed to receive part of a flexible current lead 11 which connects each current lead terminal 10 to a moveable contact element 12. Each contact element 12 is mounted atop an insulator post 13 which has the same or similar construction as the insulator post 7. The bottoms of the three insulator post 13 are all secured to a common switch shaft 14, the two ends of which are mounted to the side members 3 and 4 for pivotal movement with respect thereto.

The second cross member 6 also carries three insulator posts 15 atop each of which is fastened a transverse support 16. Each support 16 houses a current quenching device 17 for the cutoff of load currents. The supports 16 further each carry contact blades 20 for establishing permanent contact with the contact element 12 when the break switch 1 is in its closed position.

In FIGS. 1 and 2, the break switch 1 is shown in its open position, with the switching arm (formed by the contact elements 12, insulator posts 3 and switch shaft 14) in a position which is approximately parallel to the fixed insulator posts 7. For closing, the switch shaft 14 is rotated to swivel the insulator posts 13 clockwise until each contact element 12 is brought into engagement with respective contact blades 20. At the same time, a sliding blocktype driver 21 on each post 13 comes into engagement with a head 22 of the corresponding current quenching device 17. For opening, the switch shaft 14 is rotated in the opposite direction, whereby each contact element 12 is separated from the associated contact blades 20. The switch pin 23 of each quenching device 17 is extracted by the driver 21 (along the dot-dash line 24 in FIG. 1) and thereby the flowing load current in the interior of each quenching device 17 is interrupted. Toward the end of the switching movement, the head 22 of the pin 23 detaches from the driver 21 and returns to its inoperative position (shown in FIG. 1) under the action of a return spring contained within the device 17.

The switching operation is controlled by a drive mechanism which comprises, in addition to the switch shaft 14, an actuating shaft 24 which is mounted parallel to the switch shaft 14 between the side members 3 and 4 of the support frame 2 and which has ends 25 and 26 which project beyond the side members on each side (FIG. 2). The ends 25 and 26 can be used to open and close the break switch 1.

As can be seen in FIGS. 1 and 2, the actuating shaft 24 is arranged relatively close to the switch shaft 14 so that there exists a space between the actuating shaft 24 and the parts of the current path positioned above the cross member 6 into which an insulating plate 18 (indicated in phantom in FIG. 1) can be inserted in known manner. Such an insulating plate serves to completely separate voltage-carrying supports 16 and the contact elements mounted thereon from the drive mechanism, which—except for slightly protruding parts—is arranged entirely between the actuating shaft 24 and the cross member 5.

Further details of the driver 21 are given in the commonly-assigned, U.S. Pat. No. 4,417,112 of Kueenzle, et al., filed simultaneously herewith and entitled "Load Break Switch with Current Quenching Device."

The drive mechanism comprises one set of closing springs 27 and one set of opening springs 28 (FIG. 2), jointly tensionable by the actuating shaft 24. Whereas, in principle one spring each for closing and for opening would suffice, it is advantageous for the same drive energy to use two springs of smaller diameter rather than one spring of larger diameter. The smaller diameter springs permit a more compact parallel arrangement which can be better accommodated in the plane of the support frame 2. As shown in FIG. 2, the closing springs 27 and the opening springs 28 are arranged spaced in an approximately symmetrical distribution relative to the width of the support frame 2.

Figure 4:
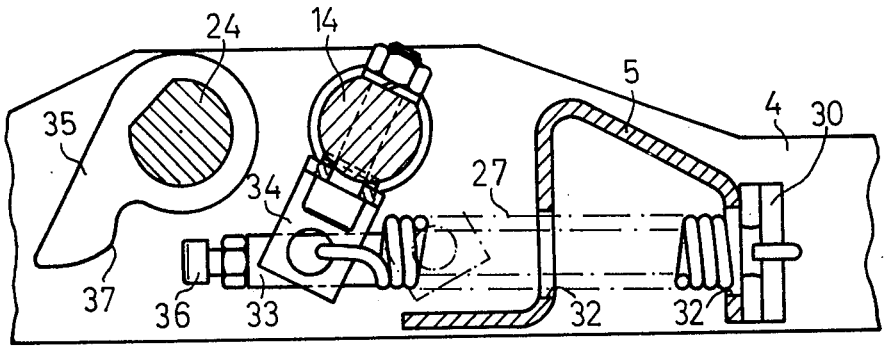
FIG. 4 is a section view taken along the line IV—IV in FIG. 2.

The closing springs 27 are coupled at their one end by a crosspiece 30 which is attached to a guide rod 33 which passes through openings 31 of the cross member 5 (FIG. 2). As shown in FIG. 4, additional openings 32 in the cross member 5 provide passageways for the closing springs 27, whose opposite ends engage a crank arm 34 which is secured to the switch shaft 14.

The actuating shaft 24 carries a finger-like lever 35. When the shaft 24 rotates counterclockwise, as viewed in FIG. 4, the striking surface 37 of the lever 35 strikes the end piece 36 of the guide rod 33. This moves the guide rod 33 to the right as viewed in FIG. 4, through the openings 31 (FIG. 2) of the cross member 5, and simultaneously biases the closing springs 27. The lever 35 can move in the opposite direction without moving the closing springs 27 since then the striking surface 37 is lifted up from the end piece 36.

Figure 5:
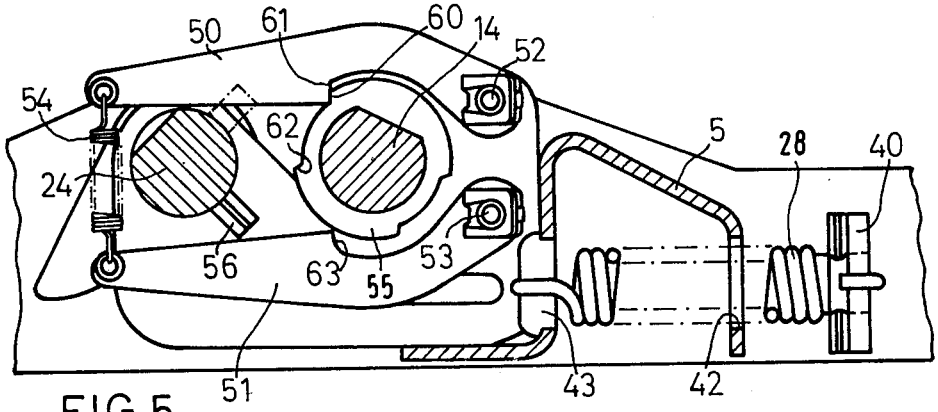
FIG. 5 is a section view taken along the line V—V in FIG. 2.
Figure 6:
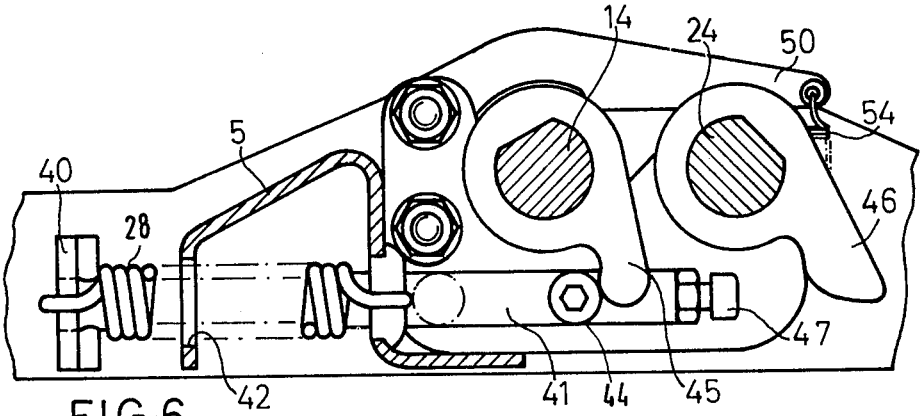
FIG. 6 is a section view (rotated 180° relative to FIGS. 4 and 5) taken along the line VI—VI in FIG. 2.

As seen in FIGS. 2, 5 and 6, a similar arrangement is provided for the opening springs 28. They, too, are coupled at their one ends to a cross piece 40 which is fastened to a guide rod 41. Again, openings 42 are provided in the cross member 5 for the passage of the two opening springs 28 and for the lengthwise displacement of the guide rod 41. Unlike the opposite ends of the closing springs 27, however, the ends of the opening springs 28 opposite the cross piece 40 are supported in abutments 43 which are received within the recesses of the cross member 5. For opening the switch 1, a drive pin 44 (FIG. 6) is provided on the guide rod 41. A driving lever 45 (similar to the lever 35) mounted on the switch shaft 14 cooperates with the pin 44. A tensioning lever 46 is provided on the actuating shaft 24 to act on an adjustable end piece 47 of the guide rod 41 for tensioning the opening springs 28.

To control the closing and opening operations, the pawl arrangement shown in FIG. 5 is provided, which comprises a closing pawl arm 50 and an opening pawl arm 51. The pawl arms 50, 51 are pivotally mounted at their one ends by means of bearing bolts 52, 53 respectively. Their other ends are biased toward each other by means of a spring 54. As can be seen, the pawl arms 50 and 51 engage in plier fashion around a ratchet disc 55 which is mounted on the switch shaft 14 (FIG. 5). The actuating shaft 24 carries a release pin 56 which, depending on the angular position of the actuating shaft 24, cooperates with either the closing pawl arm 50 or the opening pawl arm 51 to lift the respective arm out of its locked position.

In the starting or inoperative position of the drive mechanism shown in FIGS. 4–6, the springs 27, 28 are relaxed and the actuating shaft 24 is at an angular position which corresponds to the open position of the break switch 1. The shoulder 61 of the closing pawl arm 50 is latched adjacent a step 60 of the ratchet disc 55. When the actuating shaft 24 is rotated (counterclockwise as seen in FIGS. 4 and 5, and clockwise as seen in FIG. 6), after passing through an idle stroke during the time of travel of the levers 35 and 46 from their starting position to positions of contact with the end pieces 36 and 47, the closing springs 27 and the opening springs 28 are stressed. In the angular position of the actuating shaft 24 which corresponds to complete stressing of the springs 27, 28, the release pin 56 of the actuating shaft 24 strikes against the closing pawl arm 50 (dot and dash position in FIG. 5) and lifts it up against the bias force of the spring 54, thereby raising the shoulder 61 of the pawl arm 50 away from the step 60 of the latch disc 55 and releasing the switch shaft 14. The switching arm with the insulator post 13 carrying the contact elements 12 is now moved (as already described) in the direction of the support 16 and the associated quenching device 17 and contact blades 20.

When the switch 1 has been brought into its closed position, a shoulder 63 of the opening pawl arm 51 drops into a locked position adjacent another step 62 of the ratchet disc 55 and thereby locks the springs 27, 28 in their stressed positions. Thus, while the described device operates as a snap drive for closing, it acts as a stored-energy drive for opening, because the opening energy is already available and needs only to be called into use.

Opening the switch 1 is effected by rotating the actuating shaft 24 in the opposite direction (clockwise in FIGS. 4 and 5, and counterclockwise in FIG. 6) codirectionally with the required rotation of the switch shaft 14 until the release pin 56 strikes against the opening pawl arm 51 (as shown in solid lines in FIG. 5) to lift its shoulder 63 away from the step 62 of the ratchet disc 55. The guide rod 41 is now freed to move under the influence of the springs, and the drive pin 44 which already abuts the driving lever 45 transmits the spring force to the switch shaft 14 and moves the switching arm back into the starting position shown in FIG. 1.

Figure 3:
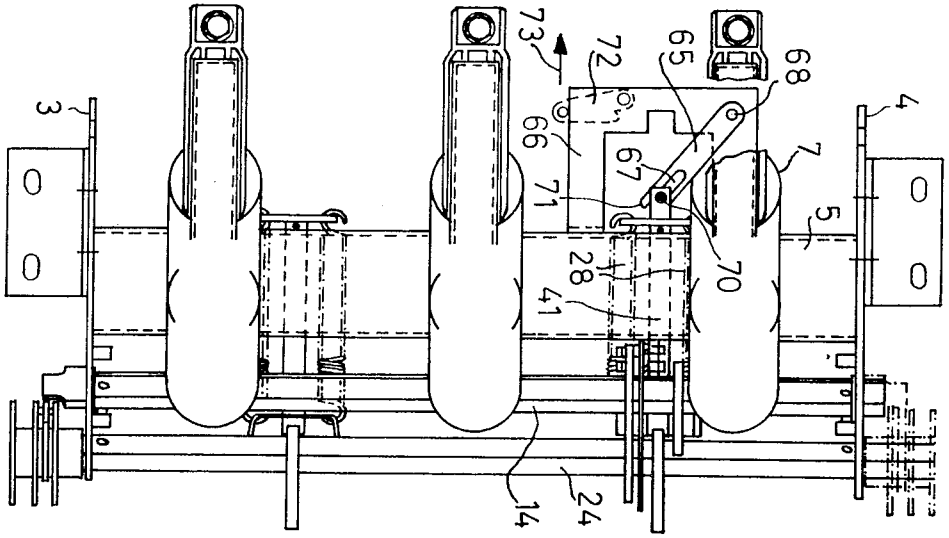
FIG. 3 is a partial view (corresponding to the view of FIG. 2) of a modified form of embodiment of the break switch of FIG. 1.

A modified embodiment of the break switch 1 is shown in FIG. 3 which is configured to operate with automatic release. Instead of the opening pawl arm 51 (FIG. 5), the embodiment of FIG. 3 has a differently formed pawl arm 65 which is pivotally mounted on a support sheet member 66 connected to the cross member 5. At its end opposite its pivot point, the pawl arm 65 has an oblong slot 67 which receives a pin 70 that is installed at the end of the guide rod 41. The end of the pawl arm 65 adjacent the entrance of the slot 67 is formed as a ratchet lug 71 which in the switch closed position engages a pawl 72 also mounted on the support sheet member 66. By swinging the pawl 72 in the direction of the arrow 73 (FIG. 3) when the switch is closed, the pawl arm 65 is released. This can, for example, be accomplished using the strike pin of a quick-break fuse of a type commonly used in conjunction with break switches, or by any other suitable tripping device or mechanism.

As is apparent from the above description, a drive mechanism formed in accordance with the principles of the invention offers the advantages of space-savings, compactness and simplicity of construction. Since a load break switch employing the inventive mechanism can be selectively actuated from either side, the switch offers increased switching system configuration flexibility. Further, because it functions as a stored-energy drive for opening, a load break switch utilizing the improved drive mechanism of the invention can be manually switched in rapid manner, and with only minor modification can be configured for automatic or remotecontrolled switch opening.

Having thus described the invention with particular reference to the preferred forms thereof, it will be obvious to those skilled in the art to which the invention pertains, after understanding the invention, that various changes and modifications may be made therein without departing from the spirit and scope of the invention as defined by the claims appended hereto. It will be appreciated that the selection, connection and layout of the various components of the described configurations may be varied to suit individual tastes and requirements.

What is claimed is:

1. In a load break switch, such as a load break switch of the "swivel post" type, having a generally planar support frame with two side members and first and second cross members connecting the side members to provide support for fixed assemblies of adjacent current paths; and also having a drive mechanism comprising an actuating shaft mounted on the side members, a switch shaft and actuation components including springs coupling the actuating shaft and the switch shaft for opening and closing the switch the improvement comprising:

the actuating shaft being mounted to project beyond the side members at each side of the support frame; and the springs being arranged generally within the plane of the support frame and the actuation components are positioned in the space between the actuating shaft and one of the cross members, wherein the actuation components include first and second guide rods mounted for reciprocal movement of the first member, first and second levers mounted on the switch shaft, a latch disc having steps and being mounted on the switch shaft, a switch opening pawl and a switch closing pawl both mounted on one side of the first cross member and connected in plier fashion around the latch disc, and biased to be received into a step thereof, and a release pin mounted on the actuating shaft to lift the switch opening pawl or the switch closing pawl out of a step of the latch disc during switch actuation, and the springs comprise opening and closing springs connected by their one ends to the first and second guide rods, respectively, and cooperating by their other ends with the first and second levers, respectively.

2. In a load break switch of the "swivel post" type, wherein oppositely disposed current lead carrying first and second insulation posts are fixedly respectively mounted on first and second cross members of an underlying generally planar support frame; a further contact carrying insulator post carried on a switch shaft pivotally mounted at its ends to side members of the support frame; a flexible lead for establishing electrical contact between the current lead carried on the first insulator post and the contact carried on the further post; and switch actuating means to control pivoting of the further post, the actuating means comprising an actuating shaft extending between the side members of the support frame and actuation components, including springs, connecting the actuating shaft and the switch shaft for actuating the switch, the improvement comprising:

the actuating shaft being constructed to project beyond the side members at each side of the support frame; and the springs being arranged generally within the plane of the support frame and the actuation components are positioned in the space between the actuating shaft and one of the cross members, wherein the actuation component include first and second guide rods mounted for reciprocal movement on the first cross member, first and second levers mounted on the switch shaft, a latch disc having steps and being mounted on the switch shaft, a switch opening pawl and a switch closing pawl being mounted on one side of the first cross member and connected in plier fashion around the latch disc, and biased to be received into a step thereof, and a release pin mounted on the actuating shaft to lift the switch opening pawl or the switch closing pawl out of a step of the latch disc during switch actuation; and the springs comprise opening and closing springs connected by their one ends to the first and second guide rods, respectively, and cooperating by their other ends with the first and second levers, respectively.

3. An improvement as defined in claim 1 or 2, wherein the drive mechanism is configured for automatic switch opening, the actuation components further comprising:

a fixed support member connected to the first cross member; and a pawl arm mounted for pivotal movement on the fixed support member and engaging the first guide rod in sliding block fashion.

4. In a load break switch for the medium voltage range, in particular a pivoting switch, with a frame including lateral cheeks and sectional bars connecting the latter, wherein the sectional bars serve as supports of fixed assemblies of adjacent current tracks, also with a drive device which comprises an actuating shaft which is mounted in the cheeks spaced from the sectional bar assigned to the fixed contacts and which is accessible on both sides of the frame for selective attachment of an outer actuating element and further comprises a switch shaft as well as springs cooperating with said shafts for intermittent switching on and off, the improvement wherein a switch-on spring and a separate switch-off spring are arranged substantially in the plane of the frame and these springs together with the switch shaft lying parallel to the actuating shaft and the parts of the drive device cooperating with both shafts are arranged in the space between the actuating shaft and the sectional bar correlated with the fixed contacts, each of the springs being connected at its one end with a respective guide bar displaceably mounted in this sectional bar, the end thereof opposite the junction with the spring cooperating with a clamping lever fitted on the actuating shaft.

5. The load break switch according to claim 4, wherein for switching on and for switching off, a pawl mounted on one sectional bar and liftable by a release pin of the actuating shaft is provided, and both pawls are arranged to grip in plier fashion a latch disk seated on the switch shaft.

6. The load break switch according to claim 4, wherein for automatic switching off, a pawl lever pivotable about a fixed bearing engages in slide-block fashion at the guide rod of the switch-off spring.

7. Load break switch according to claim 4, wherein the actuating shaft for the selective right-hand or left-hand drive by a hand lever or the like is designed protruding on both sides over the cheeks of the frame.

* * * * *